US007861791B2

(12) United States Patent
Kilgore et al.

(10) Patent No.: US 7,861,791 B2
(45) Date of Patent: Jan. 4, 2011

(54) HIGH CIRCULATION RATE PACKER AND SETTING METHOD FOR SAME

(75) Inventors: Marion D. Kilgore, Clifton, TX (US); Michael D. Ezell, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 12/118,836

(22) Filed: May 12, 2008

(65) Prior Publication Data

US 2009/0277651 A1 Nov. 12, 2009

(51) Int. Cl.
*E21B 33/12* (2006.01)

(52) U.S. Cl. ..... 166/387; 166/120; 166/152

(58) Field of Classification Search ..... 166/120, 166/122, 152, 187, 387
See application file for complete search history.

(56) References Cited

U.S. PATENT DOCUMENTS

| | | | | |
|---|---|---|---|---|
| 3,891,034 | A | 6/1975 | Owen et al. | |
| 3,916,999 | A | 11/1975 | Ellis et al. | |
| 4,224,987 | A * | 9/1980 | Allen | 166/120 |
| 5,333,692 | A | 8/1994 | Baugh et al. | |
| 5,433,269 | A * | 7/1995 | Hendrickson | 166/134 |
| 5,511,620 | A | 4/1996 | Baugh et al. | |
| 5,701,954 | A | 12/1997 | Kilgore et al. | |
| 5,720,343 | A | 2/1998 | Kilgore et al. | |
| 5,803,177 | A * | 9/1998 | Hriscu et al. | 166/305.1 |
| 5,884,699 | A | 3/1999 | Mullen et al. | |
| 5,906,240 | A | 5/1999 | Kilgore et al. | |
| 5,944,102 | A | 8/1999 | Kilgore et al. | |
| 6,056,052 | A | 5/2000 | Mullen et al. | |
| 6,112,811 | A | 9/2000 | Kilgore et al. | |
| 6,257,338 | B1 | 7/2001 | Kilgore | |
| 6,267,180 | B1 | 7/2001 | Gazda et al. | |
| 6,302,217 | B1 | 10/2001 | Kilgore et al. | |
| 6,446,717 | B1 | 9/2002 | White et al. | |
| 6,478,093 | B1 | 11/2002 | Hilts et al. | |
| 6,536,532 | B2 * | 3/2003 | Doane | 166/387 |
| 6,547,011 | B2 | 4/2003 | Kilgore | |
| 6,691,788 | B1 | 2/2004 | Dearing | |
| 6,793,022 | B2 | 9/2004 | Vick et al. | |
| 6,854,522 | B2 | 2/2005 | Brezinski et al. | |
| 6,860,326 | B2 | 3/2005 | Kilgore et al. | |
| 7,055,596 | B2 | 6/2006 | Kilgore et al. | |
| 7,165,622 | B2 | 1/2007 | Hirth et al. | |
| 7,198,110 | B2 | 4/2007 | Kilgore et al. | |
| 7,231,987 | B2 | 6/2007 | Kilgore et al. | |
| 7,252,142 | B2 | 8/2007 | Brezinski et al. | |
| 7,320,367 | B2 | 1/2008 | Brezinski et al. | |
| 7,363,986 | B2 | 4/2008 | Brezinski et al. | |
| 2009/0277651 | A1 * | 11/2009 | Kilgore | 166/387 |

* cited by examiner

*Primary Examiner*—Jennifer H Gay
(74) *Attorney, Agent, or Firm*—Lawrence R. Youst

(57) ABSTRACT

A high circulation rate packer (50) for establishing a sealing and gripping engagement with a well casing (34) disposed in a wellbore (32). The packer (50) includes a packer mandrel (54), a seal assembly (72) slidably disposed about the packer mandrel (54) that has a running position and a radially expanded sealing position and a cover (74) that is slidably disposed relative to the packer mandrel (54). The cover (74) has a running position wherein the cover is disposed about the seal assembly (72) and a retracted position wherein the cover (74) is at least partially removed from about the seal assembly (72).

25 Claims, 4 Drawing Sheets

HIGH CIRCULATION RATE PACKER AND SETTING METHOD FOR SAME

TECHNICAL FIELD OF THE INVENTION

This invention relates, in general, to tools and equipment for completing a subterranean well that traverses a hydrocarbon bearing formation and, in particular, to a downhole packer having a slidable cover over a seal assembly to protect the seal assembly from damage during high rate circulation of viscous fluids prior to setting.

BACKGROUND OF THE INVENTION

Without limiting the scope of the present invention, its background will be described in relation to setting packers, as an example.

In the course of treating and preparing a subterranean well for production, well packers are commonly run into the well on a conveyance such as a work string or production tubing. The purpose of the packer is to support production tubing and other completion equipment, such as sand control assemblies adjacent to a producing formation, and to seal the annulus between the outside of the production tubing and the inside of the well casing to block movement of fluids through the annulus past the packer location.

Typically, packers may have an upper and a lower set of anchor slips with opposed camming surfaces, which cooperate with complementary opposed wedging surfaces, whereby the anchor slips are outwardly radially extendable into gripping engagement against the well casing bore in response to relative axial movement of the wedging surfaces. Packers may also carry annular seal assembly including one or more seal elements, which are radially expandable into sealing engagement against the bore of the well casing in response to axial compression forces.

Prior to actuation and the subsequent radial expansion of the seal elements, many adverse environmental conditions may exist around the outer diameter of the seal elements. For example, certain completion operations require viscous fluids to be circulated in the annulus between the well casing and the tubing string at high rates.

It has been found that these high flow rates of viscous wellbore fluids may create a low pressure region around and adjacent to the outer diameter of the packers and the seal elements. It has also been found that this low pressure region may cause the seal elements to radially expand prematurely, thus causing their exposed surfaces to be further damaged by abrasive contact with the high flow rate wellbore fluids.

This premature contact with the high flow rate wellbore fluids may further accelerate the destruction of the seal elements prior to setting, which in turn, reduces the capability of the packer to provide the desired seal between the outside of the production tubing and the inside of the well casing.

Therefore, a need has arisen for a packer that is capable of being deployed in adverse environments such that its seal elements are not affected by the adverse environments, such as high circulation rate fluids, prior to setting the packer.

SUMMARY OF THE INVENTION

The present invention disclosed herein comprises a high circulation rate packer. The high circulation rate packer of the present provides protection for the seal elements from the adverse downhole environments, such as high circulation rates of wellbore fluids, prior to radial expansion of the seal elements of the packer.

In one aspect, the high circulation rate packer of the present invention includes a slidable cover that covers the seal elements prior to radial expansion of the seal elements downhole. The slidable cover is rigid and impervious to pressure drops and abrasive fluids downhole. The slidable cover is located over the expandable seal elements until a setting sequence of the packer is initiated. During the setting sequence, the slidable cover may be longitudinally or axially shifted thereby exposing the seal elements and allowing radial expansion thereof.

In another aspect, the present invention is directed to a high circulation rate packer for establishing a sealing and gripping engagement with a well casing disposed in a wellbore. The high circulation rate packer includes a packer mandrel and a seal assembly slidably disposed about the packer mandrel, the seal assembly having a running position and a radially expanded sealing position. The high circulation rate packer also includes a cover slidably disposed relative to the packer mandrel, the cover having a running position wherein the cover is disposed about the seal assembly and a retracted position wherein the cover is at least partially removed from about the seal assembly.

In one embodiment, the cover that is made from a rigid impervious sheet type material. The cover may also be a material that is impervious to downhole fluids. The cover, in its running position, may cover substantially the entire outer surface of the seal assembly. The cover may further include a locking mechanism that locks the cover in the retracted position.

In another aspect, the present invention is directed to a high circulation rate packer for establishing a sealing and gripping engagement with a well casing disposed in a wellbore. The high circulation rate packer includes a packer mandrel and a seal assembly disposed about the packer mandrel. The seal assembly has a running position and a radially expanded sealing position. A slip wedge is slidably disposed about the packer mandrel, the slip wedge has a running position and a setting position. A slip assembly is slidably disposed about the packer mandrel and operably associated with the slip wedge. The slip assembly has a running position and a radially expanded gripping position. A cover is slidably disposed relative to the packer mandrel and operably associated with the slip wedge. The cover has a running position wherein the slidable cover is disposed about the seal assembly and a retracted position, when the slip wedge is in the setting position, wherein the cover is at least partially removed from about the seal assembly.

The packer mandrel may further include a first outer diameter portion and a second outer diameter portion wherein the second outer diameter portion is greater than the first outer diameter portion, wherein the second outer diameter portion supports the seal assembly in the sealing position and the first outer diameter portion supports the seal assembly in the running position. The high circulation rate packer may include a piston slidably disposed about the packer mandrel and operably associated with the seal assembly for forcing the seal assembly between the running position and the sealing position. The high circulation rate packer may also include an element backup shoe slidably disposed about the packer mandrel and operably associated with the seal assembly, the element backup shoe having a running position wherein the element backup shoe is not in sealing engagement with the well casing and a sealing position wherein the element backup shoe is in sealing engagement with the well casing.

In a further aspect, the present invention is directed to a high circulation rate packer for establishing a sealing and gripping engagement with a well casing disposed in a wellbore. The high circulation rate packer includes a packer mandrel, a piston slidably disposed about the packer mandrel, the piston having a running position and a setting position, a slip wedge slidably disposed about the packer mandrel, the slip wedge having a running position and a setting position and a cylinder slidably disposed about the piston and operably associated with the slip wedge. A pick-up ring is disposed radially between the packer mandrel and the cylinder and longitudinally between the slip wedge and the piston. The pick-up ring is in fluid communication with an interior cylindrical bore of the packer mandrel. The pick-up ring, the piston and the cylinder define a first chamber and the pick-up ring, the slip wedge and the cylinder define a second chamber that may be in fluid communication with the first chamber. A slip assembly is slidably disposed about the packer mandrel and operably associated with the slip wedge. The slip assembly has a running position and a radially expanded gripping position, when the slip wedge is in the setting position. A cover is slidably disposed relative to the packer mandrel and operably associated with the slip wedge. The cover has a running position wherein at least a portion of the cover is disposed about the seal assembly and a retracted position, when the slip wedge is in the setting position, wherein the cover is at least partially removed from about the seal assembly.

In one embodiment, fluid pressure in the second chamber acts upon the slip wedge in a first direction to operate the slip wedge from the running position to the setting position, thereby operating the slip assembly from the running position and the radially expanded gripping position. In another embodiment, fluid pressure in the first chamber acts upon the piston in a second direction to operate the seal assembly from the running position to the sealing position. In a further embodiment, a shear ring prevents the piston from operating the seal assembly to the sealing position until the slip assembly is in the gripping position. Also, a locking mechanism may be operably associated with the cover that locks the cover in the retracted position when the slip assembly is in the gripping position.

In yet another aspect, the present invention is directed to a method for setting a packer to establish a sealing and gripping engagement with a well casing including lowering the packer into the well casing to a selected location, applying fluid pressure to an expandable chamber within the packer, responsive to the fluid pressure, radially setting a slip assembly into gripping engagement with the well casing and sliding a cover disposed about a seal assembly to at least partially expose a seal assembly, and responsive to the setting of the slip assembly and the fluid pressure, radially outwardly extending the seal assembly into sealing engagement with the well casing.

The method may also include contacting the slip assembly with a slip wedge, forcing the seal assembly from a first outer diameter portion of the packer mandrel to a second outer diameter portion of the packer mandrel, the second outer diameter portion being greater than the first outer diameter portion, longitudinally sliding a piston slidably disposed about the packer to operate the seal assembly into the sealing engagement with the well casing, and setting at least one element backup shoe positioned substantially adjacent to the seal assembly into sealing engagement with the well casing.

In another aspect, the present invention is directed to a method for setting a packer to establish a sealing engagement with a well casing including lowering the packer into the well casing to a selected location, sliding a cover disposed about a seal assembly to expose the seal assembly and radially outwardly extending the seal assembly into sealing engagement with the well casing.

The method may also include sliding a piston slidably disposed about the packer to force the seal assembly into the sealing engagement with the well casing, shearing shear pins retaining the piston, forcing the seal assembly from a first outer diameter portion of the packer mandrel to a second outer diameter portion of the packer mandrel, the second outer diameter portion being greater than the first outer diameter portion, and setting at least one element backup shoe positioned substantially adjacent to the seal assembly into sealing engagement with the well casing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
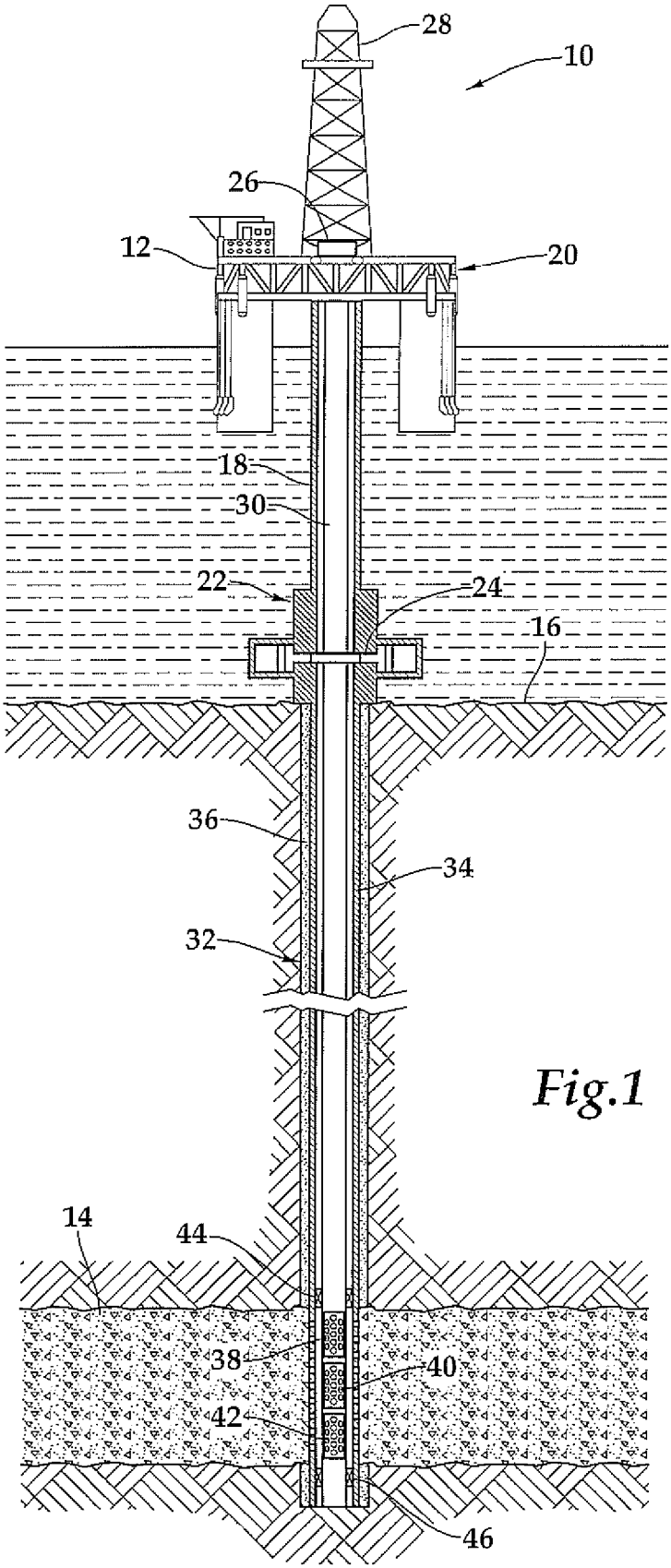
FIG. 1 is a schematic illustration of an offshore platform operating a high circulation rate packer in accordance with the present invention.

Referring initially to FIG. 1, a pair of packers in a work string deployed in an offshore oil or gas well is schematically illustrated and generally designated 10. A semi-submersible platform 12 is centered over a submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including sand control screens 38, 40, 42 positioned in an interval of wellbore 32 adjacent to formation 14 between packers 44, 46 of the present invention.

Importantly, even though FIG. 1 depicts a vertical well, it should be understood by one skilled in the art that the packers of the present invention are equally well-suited for use in deviated wells, inclined wells or horizontal wells. Also, even though FIG. 1 depicts an offshore operation, it should be understood by one skilled in the art that the packers of the present invention are equally well-suited for use in onshore operations.

Note that, in this specification, the terms "liner" and "casing" are used interchangeably to describe tubular materials, which are used to form protective linings in wellbores. Liners and casings may be made from any material such as metals, plastics, composites and the like, may be expanded or unexpanded as part of an installation procedure and may be segmented or continuous. Additionally, it is not necessary for a liner or casing to be cemented in a wellbore. Any type of liner or casing may be used in keeping with the principles of the present invention.

Figure 2A:
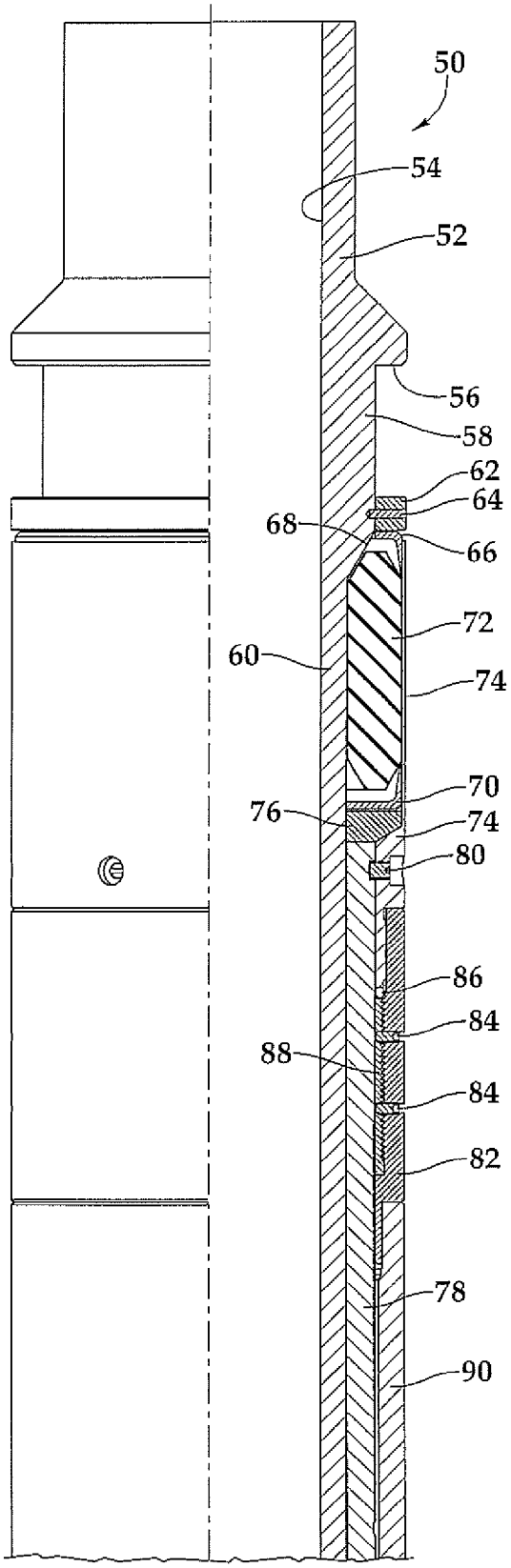
FIGS. 2A-2B are quarter-section views of an exemplary high circulation rate packer of the present invention in a running configuration in accordance with the present invention.
Figure 2B:
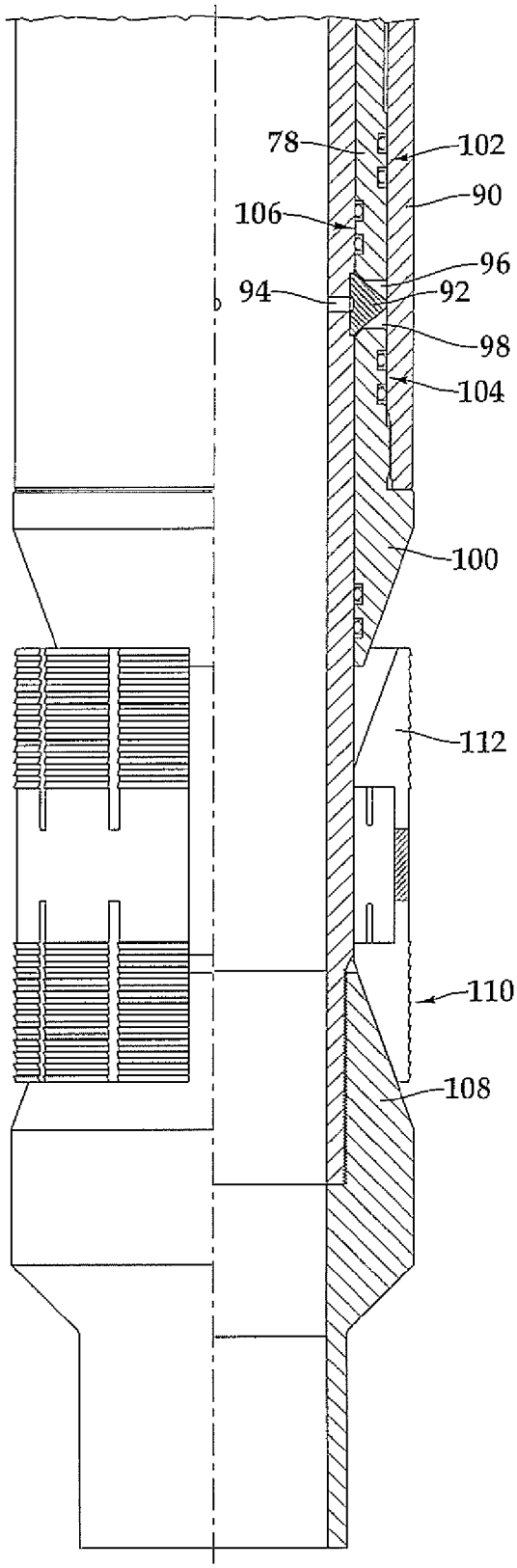

Referring now to FIGS. 2A-2B, therein is depicted a packer of the present invention that is generally designated 50. Packer 50 includes a substantially tubular, longitudinally extending mandrel 52 having a substantially cylindrical bore 54 defining a longitudinal production flow passageway. Mandrel 52 may be coupled with a substantially tubular, longitudinally extending tubular string such as work string 30.

Mandrel 52 includes a larger outer diameter portion 58 and a smaller outer diameter portion 60. Mandrel 52 has a shoulder 56 that is adjacent to the larger outer diameter portion 58. Mandrel 52 may include a transition portion 68 between larger outer diameter portion 58 and smaller outer diameter portion 60 that is formed similar to a ramp or wedge. Slidably positioned around larger outer diameter portion 58 of mandrel 52 is a shear ring 62 having one or more shear pins associated therewith such as shear pin 64. Shear ring 62 may slide around larger outer diameter portion 58 after shear pin 64 is broken until shear ring 62 contacts shoulder 56. Shear pin 64 may be designed to shear at any desirable shear force.

Substantially adjacent to shear pin 64 is an upper element backup shoe 66 that is slidably positioned around larger outer diameter portion 58 of mandrel 52. Additionally, a seal assembly, depicted as expandable seal element 72, is slidably positioned around smaller outer diameter portion 60 between upper element backup shoe 66 and a lower element backup shoe 70. Adjacent to lower element backup shoe 70 and slidably positioned around smaller outer diameter portion 60 of mandrel 52 is an element retainer 76. Also slidably positioned around the smaller outer diameter portion 60 of mandrel 52 is a piston 78 that is substantially adjacent to element retainer 76. In the illustrated embodiment, one expandable seal element 72 is shown; however, a seal assembly of the packer of the present invention may include any number of expandable seal elements.

Upper element backup shoe 66 and lower element backup shoe 70 may be made from a deformable or malleable material, such as mild steel, soft steel, brass, and the like and may be thin cut at their distal ends. The ends of upper element backup shoe 66 and lower element backup shoe 70 will deform and flare outwardly toward the inner surface of the casing or formation during the setting sequence as further described below. In one embodiment, upper element backup shoe 66 and lower element backup shoe 70 form a metal-to-metal barrier between packer 50 and the inner surface of the casing.

Packer 50 further includes a slidable cover 74 that has a substantially thinner portion covering expandable seal element 72 and a thicker portion that is slidably positioned around piston 78. A shear screw 80 is located between slidable cover 74 and piston 78. Upon shearing, slidable cover 74 and piston 78 may slide relatively independently of each other. In the illustrated running configuration, slidable cover 74 substantially covers expandable seal element 72.

A body lock housing 82 is located substantially adjacent to and partially around slidable cover 74. Disposed within body lock housing 82 are one or more set screws 84. A body lock ring 88 is positioned between body lock housing 82 and piston 78. A spring-loaded O-ring 86 is also positioned between body lock housing 82 and piston 78. A portion of body lock housing 82 may overlap a portion of the slidable cover 74. Either or both of body lock housing 82 and slidable cover 74 may be partially notched such that one fits within the other to continue a low profile or thickness over the overlapping region. In one embodiment, slidable cover 74 and body lock housing 82 include threaded portions for threading the two elements together as shown.

In one embodiment, body lock ring 88 has internal threads that oppose and mesh with threads located on the external of mandrel 52. Body lock ring 88 then is capable of locking itself, piston 78, mandrel 52 and a cylinder 90 as part of the setting sequence of packer 50 to prevent further relative movement once expandable seal element 72 has been set in accordance with the process described below.

Slidably positioned substantially around piston 78 is cylinder 90. Further, a portion of cylinder 90 may overlap a portion of body lock housing 82. Either or both of cylinder 90 and body lock housing 82 may be partially notched or threaded such that one fits within the other to continue a low profile or thickness over the overlapping region and to couple the two members together.

A pick-up ring 92 is located at one end of piston 78 and is positioned between mandrel 52 and cylinder 90. Pick-up ring 92 is in fluid communication with a port 94 that is in fluid communication with the longitudinal production flow passageway. A chamber 96 is defined by pick-up ring 92, mandrel 52, piston 78 and cylinder 90. A chamber 98 is defined by mandrel 52, pick-up ring 92, an upper wedge 100 and cylinder 90. A pair of seals 102 are located between cylinder 90 and piston 78 to provide a sealing relationship between cylinder 90 and piston 78. A pair of seals 104 are located between cylinder 90 and upper wedge 100 to provide a sealing relationship between cylinder 90 and upper wedge 100. In addition, a pair of seals 106 are located between mandrel 52 and piston 78 to provide a sealing relationship between mandrel 52 and piston 78. Seals 102, 104, and 106 may consist of any suitable sealing element or elements, such as a single O-ring, a plurality of O-rings, as illustrated, and/or a combination of backup rings, O-rings, and the like.

In the illustrated embodiment, chamber 96 and chamber 98 are in fluid communication with each other via pick-up ring 92 and could be considered a single chamber instead of multiple chambers. Those skilled in the art, however, will recognize that a pick-up ring could alternatively isolate chamber 96 and chamber 98 from one another. In addition, chamber 96 and chamber 98 may be considered to be expandable chambers because the volume within chamber 96 and chamber 98 increases during the setting sequence of packer 50 as described below.

Slidably positioned around mandrel 52 at a preselected distance below pick-up ring 92 and threadably coupled to cylinder 90 is an upper wedge 100. Upper wedge 100 has a camming outer surface that will engage an inner surface of a slip assembly 112. As should be apparent to those skilled in the art, upper wedge 100 may have a variety of configurations including configurations having other numbers of wedge sections, such configurations being considered within the scope of the present invention.

Slip assembly 112 is located between upper wedge 100 and a lower wedge 108. In one embodiment, slip assembly 112 may have teeth 110 located along its outer surface for providing a gripping arrangement with the interior of the well casing. As explained in greater detail below, when a compressive force is generated between upper wedge 100, slip assembly 112, and lower wedge 108, slip assembly 112 is radially expanded into contact with the well casing.

Referring collectively to FIGS. 2A-2B, 3A-3B, and 4A-4B the operation of packer 50 will now be described. Packer 50 is shown before, during and after activation and expansion of the expandable seal element 72, respectively in FIGS. 2A-2B, 3A-3B and 4A-4B. As packer 50 is run into wellbore 32 in work string 30, it is normally in its running configuration as shown in FIGS. 2A-2B, with slidable cover 74 positioned such that its upper portion is covering seal element 72 and such that slidable cover 74 is coupled to piston 78 with shear screw 80. In one embodiment, a plugging device, such as a ball or a flapper, is positioned downhole of packer 50 below port 94 to enable the pressure within the cylindrical bore 54 to be increased by a pump at the surface, for example.

This increase in fluid pressure is transmitted through port 94 to pick-up ring 92 where it acts upon chamber 96 and chamber 98 of packer 50. The pressurized fluid then acts upon piston 78 with an upward force and upper wedge 100 with a downward force. As discussed above, upper wedge 100 is attached or connected to cylinder 90, thus the downward force is also transmitted to cylinder 90.

Initially, relative movement between piston 78 and cylinder 90 opposed by shear screw 80 attached between slidable cover 74 and piston 78. Once the shear force between piston 78 and cylinder 90 exceeds a predetermined amount, shear screw 80 breaks allowing the downward force of the pressurized fluid within chamber 98 acting upon upper wedge 100 and cylinder 90 to move them downward towards slip assembly 112. As upper wedge 100 contacts slip assembly 112, slip assembly 112 moves downwardly over lower wedge 108, which sets slip assembly 112 against the inner surface of casing 34. Once slip assembly 112 is set against casing 34, the fluid pressure in first chamber 96 begins to increase to a point where it becomes greater than the resistant force of shear screw 64, which then shears.

Figure 3A:
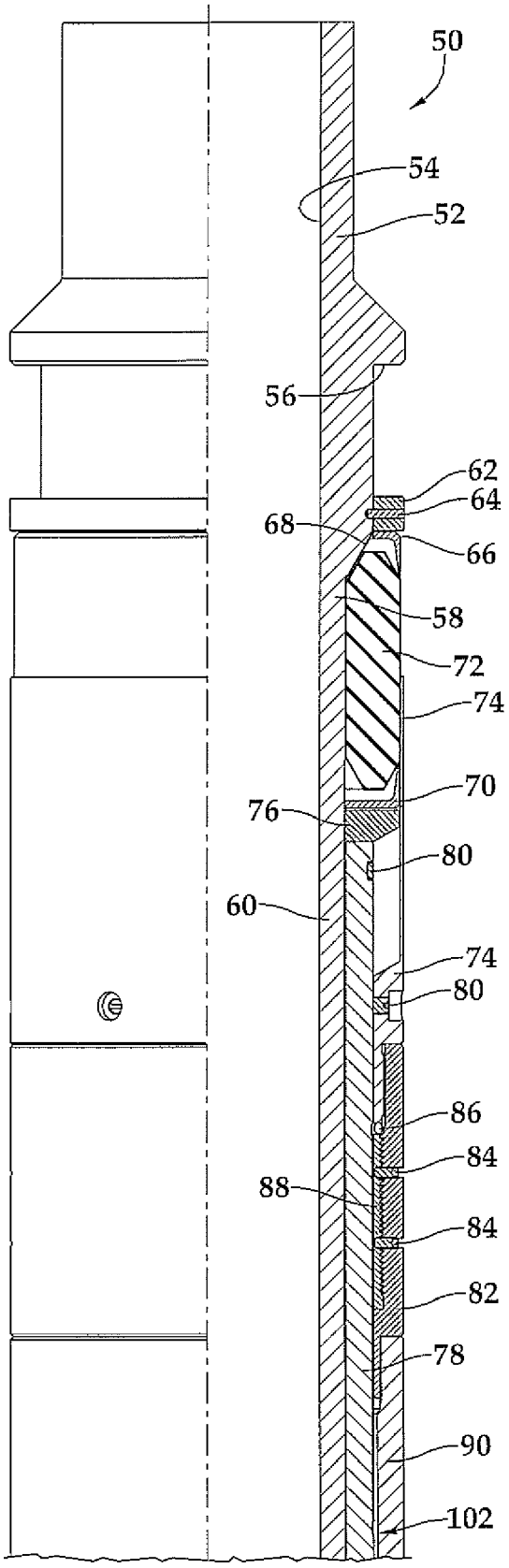
FIGS. 3A-3B are quarter-section views of the tool of FIGS. 2A-2B in a partially set configuration in accordance with the present invention.
Figure 3B:
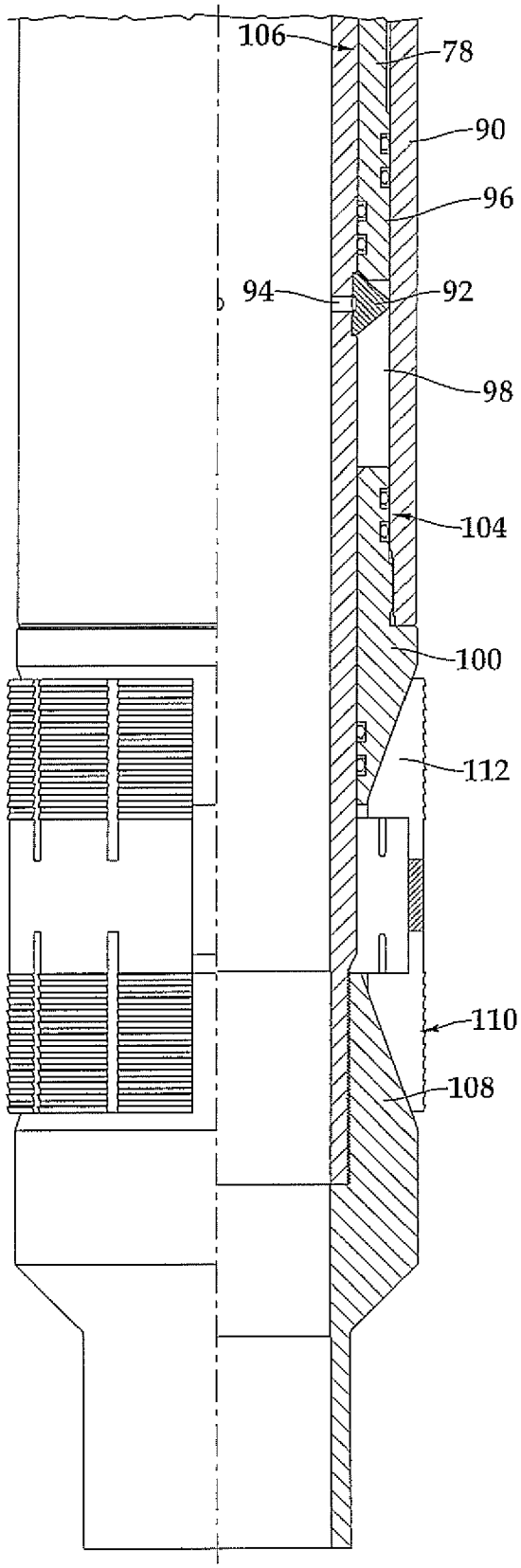

Once shear screw 64 has been sheared, piston 78, element retainer 76, lower element backup shoe 70, and expandable seal element 72 will begin to move upward relative to mandrel 52. It is important that a sufficient amount of downward travel of slidable cover 74, upper wedge 100, and cylinder 90 has previously occurred to enable the slidable cover 74 to move out of the way of the upwardly moving expandable seal element 72, as best seen in FIGS. 3A-3B. In one embodiment, this may be accomplished by providing a sufficient distance of travel between upper wedge 100 and slip assembly 112. If the distance between upper wedge 100 and slip assembly 112 is sufficient at the start of the actuation process, cylinder 90, slidable cover 74 and upper wedge 100 will travel a sufficient distance downward prior to the upward movement of expandable seal element 72 and piston 78.

As the upward travel of piston 78, element retainer 76, lower element backup shoe 70, upper element backup shoe 66 and expandable seal element 72 begin, expandable seal element 72 moves from smaller outer diameter portion 60 over transition portion 68 to larger outer diameter portion 58.

Figure 4A:
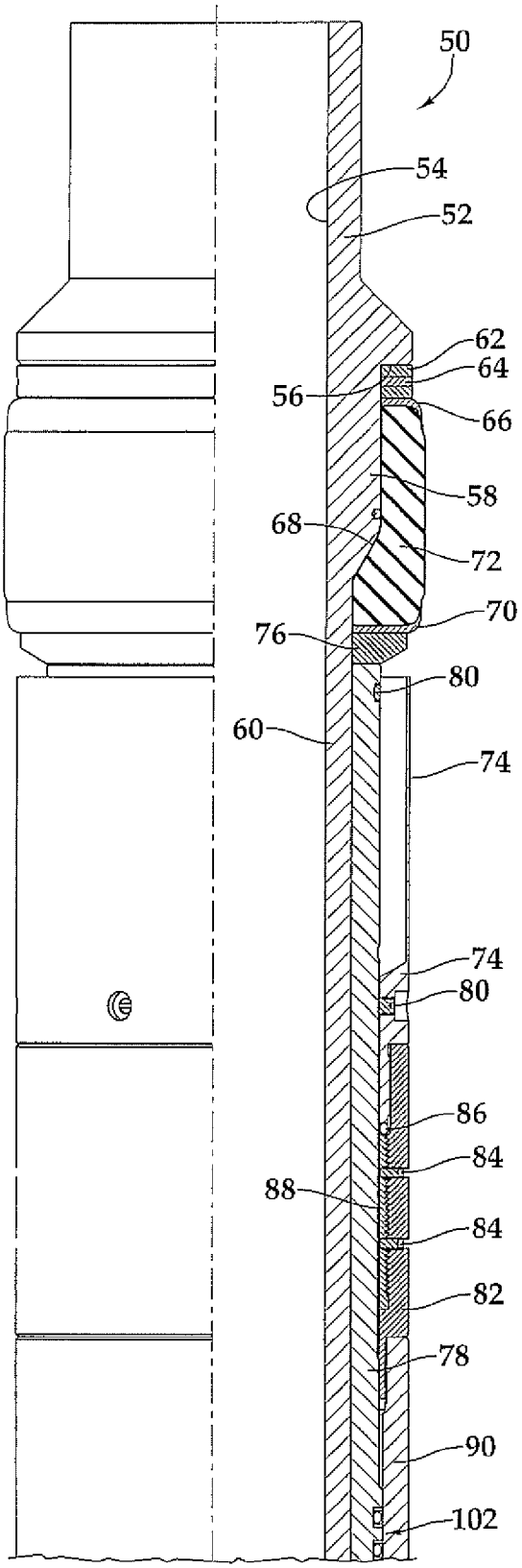
FIGS. 4A-4B are half-section views of the tool of FIGS. 2A-2B in a fully set configuration in accordance with the present invention.
Figure 4B:
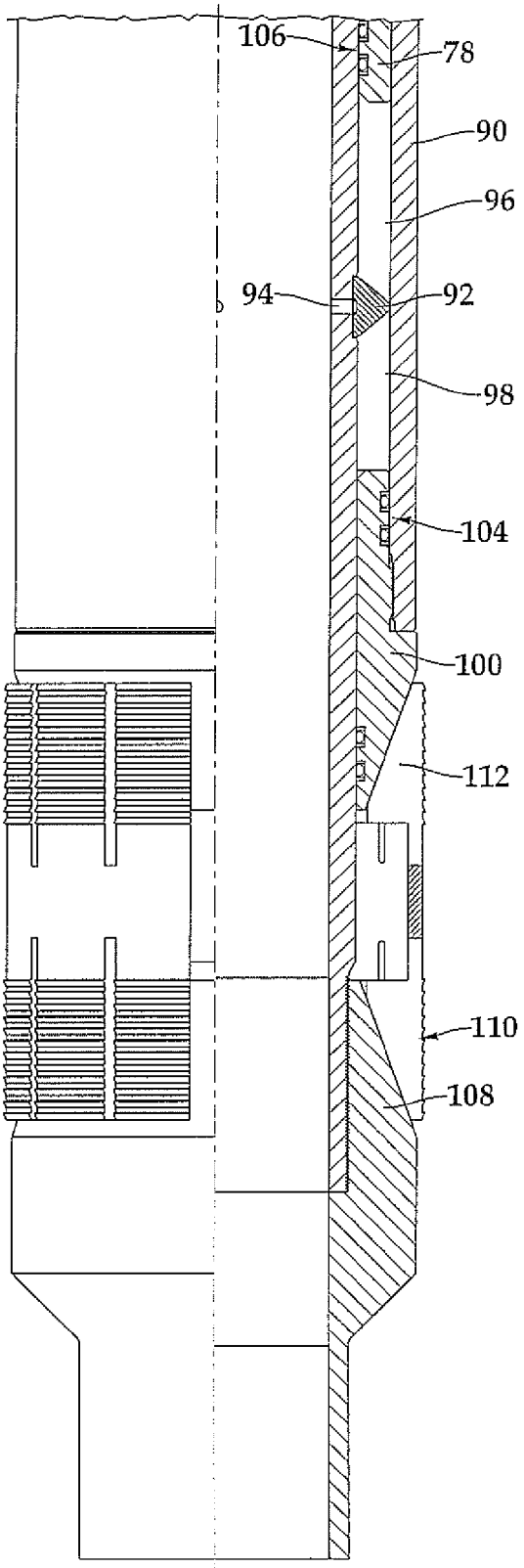

As expandable seal element 72 is forced upon the larger outer diameter portion 58, shear ring 62 and shear pin 64 are forced upward by expandable seal element 72 until they contact shoulder 56 of mandrel 52. When expandable seal element 72 moves over larger outer diameter portion 58, it seals against casing 34 and mandrel 52 of packer 50. In addition, upper element backup shoe 66 and lower element backup shoe 70 flare outward toward casing 34 to provide a metal-to-metal seal in addition to the seal of expandable seal element 72 between casing 34 and mandrel 52, as best seen in FIGS. 4A-4B.

Upon setting expandable seal element 72 against mandrel 52 and casing 34, body lock ring 88 prevents further relative movement between piston 78, body lock ring 88, and cylinder 90 to lock piston 78, element retainer 76, expandable seal element 72, and upper element backup shoe 66 into place. Thereafter the fluid pressure within cylindrical bore 54 may be decreased and production through the cylindrical bore 54 may proceed.

While the setting of the seal element of the present invention has been described as longitudinally shifting the seal element from a radially reduced to a radially increased diameter portion of the packer mandrel, those skilled in the art will recognize that other types of seal elements with other types of setting procedures could also be used and are considered to be within the scope of the present invention, those seal elements including, but not limited to, seal elements that are radially expandable into sealing engagement against the interior of the well casing in response to axial compression forces.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A high circulation rate packer for establishing a sealing engagement with a well casing disposed in a wellbore, comprising:

a packer mandrel;

a seal assembly disposed about the packer mandrel, the seal assembly longitudinally moveable relative to the packer mandrel from a running position and a radially expanded sealing position; and a cover longitudinally shiftable relative to the seal assembly, the cover having a running position wherein at least a portion of the cover is disposed about the seal assembly and a retracted position wherein the cover is at least partially removed from about the seal assembly;

wherein, after the cover is longitudinally shifted from its running position to its retracted position, the seal assembly is longitudinally moveable from its running position to its radially expanded sealing position such that the cover is entirely removed from about the seal assembly.

2. The high circulation rate packer as recited in claim 1 wherein the cover is a rigid material.

3. The high circulation rate packer as recited in claim 1 wherein the cover is a material impervious to downhole fluids.

4. The high circulation rate packer as recited in claim 1 wherein the running position of the cover substantially covers the entire outer surface of the seal assembly.

5. The high circulation rate packer as recited in claim 1 further comprising a locking mechanism operably associated with the cover that locks the cover in the retracted position.

6. A high circulation rate packer for establishing a sealing and gripping engagement with a well casing disposed in a wellbore, comprising:

a packer mandrel;

a seal assembly disposed about the packer mandrel, the seal assembly longitudinally moveable relative to the packer mandrel from a running position and a radially expanded sealing position;

a slip wedge slidably disposed about the packer mandrel, the slip wedge having a running position and a setting position;

a slip assembly slidably disposed about the packer mandrel and operably associated with the slip wedge, the slip assembly having a running position and a radially expanded gripping position, when the slip wedge is in the setting position; and a cover slidably disposed relative to the packer mandrel and operably associated with the slip wedge, the cover having a running position wherein at least a portion of the cover is disposed about the seal assembly and a retracted position, when the slip wedge is in the setting position, wherein the cover is at least partially removed from about the seal assembly;

wherein, after the cover is longitudinally shifted from its running position to its retracted position, the seal assembly is longitudinally moveable from its running position to its radially expanded sealing position such that the cover is entirely removed from about the seal assembly.

7. The high circulation rate packer as recited in claim 6 wherein the packer mandrel further comprises a first outer diameter portion and a second outer diameter portion wherein the second outer diameter portion is greater than the first outer diameter portion, and wherein the second outer diameter portion supports the seal assembly in the sealing position.

8. The high circulation rate packer as recited in claim 7 wherein the first outer diameter portion supports the seal assembly in the running position.

9. The high circulation rate packer as recited in claim 6 further comprising a piston slidably disposed about the packer mandrel and operably associated with the seal assembly for forcing the seal assembly between the running position and the sealing position.

10. The high circulation rate packer as recited in claim 6 further comprising an element backup shoe slidably disposed about the packer mandrel and operably associated with the seal assembly, the element backup shoe having a running position wherein the element backup shoe is not in sealing engagement with the well casing and a sealing position wherein the element backup shoe is in sealing engagement with the well casing.

11. A high circulation rate packer for establishing a sealing and gripping engagement with a well casing disposed in a wellbore, comprising:

a packer mandrel;

a seal assembly disposed about the packer mandrel, the seal assembly longitudinally moveable relative to the packer mandrel from a running position and a radially expanded sealing position;

a piston slidably disposed about the packer mandrel, the piston having a running position and a setting position;

a slip wedge slidably disposed about the packer mandrel, the slip wedge having a running position and a setting position;

a cylinder slidably disposed about the piston and operably associated with the slip wedge;

a pick-up ring disposed radially between the packer mandrel and the cylinder and longitudinally between the slip wedge and the piston, the pick-up ring in fluid communication with an interior cylindrical bore of the packer mandrel, the pick-up ring, the piston and the cylinder defining a first chamber, the pick-up ring, the slip wedge and the cylinder defining a second chamber;

a slip assembly slidably disposed about the packer mandrel and operably associated with the slip wedge, the slip assembly having a running position and a radially expanded gripping position, when the slip wedge is in the setting position; and a cover slidably disposed relative to the packer mandrel and operably associated with the slip wedge, the cover having a running position wherein at least a portion of the cover is disposed about the seal assembly and a retracted position, when the slip wedge is in the setting position, wherein the cover is at least partially removed from about the seal assembly;

wherein, after the cover is longitudinally shifted from its running position to its retracted position, the seal assembly is longitudinally moveable from its running position to its radially expanded sealing position such that the cover is entirely removed from about the seal assembly.

12. The high circulation rate packer as recited in claim 11 wherein fluid pressure in the second chamber acts upon the slip wedge in a first direction to operate the slip wedge from the running position to the setting position, thereby operating the slip assembly from the running position and the radially expanded gripping position.

13. The high circulation rate packer as recited in claim 12 wherein fluid pressure in the first chamber acts upon the piston in a second direction to operate the seal assembly from the running position to the sealing position.

14. The high circulation rate packer as recited in claim 13 further comprising a shear ring that prevents the piston from operating the seal assembly to the sealing position until the slip assembly is in the gripping position.

15. The high circulation rate packer as recited in claim 14 further comprising a locking mechanism operably associated with the cover that locks the cover in the retracted position when the slip assembly is in the gripping position.

16. A method for setting a packer to establish a sealing and gripping engagement with a well casing, the method comprising:

lowering the packer into the well casing to a selected location;

applying fluid pressure to an expandable chamber within the packer;

responsive to the fluid pressure, radially setting a slip assembly into gripping engagement with the well casing and sliding a cover disposed about a seal assembly to at least partially expose the seal assembly; and after sliding the cover and responsive to the fluid pressure, longitudinally moving the seal assembly relative to a packer mandrel such that the seal assembly is entirely exposed from the cover and such that the seal assembly is radially outwardly extended into sealing engagement with the well casing.

17. The method as recited in claim 16 wherein radially setting a slip assembly further comprises contacting the slip assembly with a slip wedge.

18. The method as recited in claim 16 wherein radially outwardly extending the seal assembly further comprises forcing the seal assembly from a first outer diameter portion of a packer mandrel to a second outer diameter portion of the packer mandrel, the second outer diameter portion being greater than the first outer diameter portion.

19. The method as recited in claim 16 wherein radially outwardly extending the seal assembly further comprises longitudinally sliding a piston to operate the seal assembly into the sealing engagement with the well casing.

20. The method as recited in claim 16 wherein radially outwardly extending the seal assembly further comprises setting at least one element backup shoe positioned substantially adjacent to the seal assembly into sealing engagement with the well casing.

21. A method for setting a packer to establish a sealing and gripping engagement with a well casing, the method comprising:

lowering the packer into the well casing to a selected location;

sliding a cover disposed about a seal assembly to at least partially expose the seal assembly; and after sliding the cover, longitudinally moving the seal assembly relative to a packer mandrel such that the seal assembly is entirely exposed from the cover and such that the seal assembly is radially outwardly extended into sealing engagement with the well casing.

22. The method as recited in claim 21 wherein extending the seal assembly further comprises sliding a piston to force the seal assembly into the sealing engagement with the well casing.

23. The method as recited in claim 22 wherein radially outwardly extending the seal assembly further comprises shearing shear pins retaining the piston.

24. The method as recited in claim 21 wherein radially outwardly extending the seal assembly further comprises forcing the seal assembly from a first outer diameter portion of a packer mandrel to a second outer diameter portion of the packer mandrel, the second outer diameter portion being greater than the first outer diameter portion.

25. The method as recited in claim 21 wherein radially outwardly extending the seal assembly further comprises setting at least one element backup shoe positioned substantially adjacent to the seal assembly into sealing engagement with the well casing.

* * * * *